US009423229B1

(12) United States Patent
Rice

(10) Patent No.: US 9,423,229 B1
(45) Date of Patent: Aug. 23, 2016

(54) IMPLODING BARREL INITIATOR AND RELATED METHODS

(71) Applicant: The United States of America as represented by the Secretary of the Navy, Washington, DC (US)

(72) Inventor: Brett A. Rice, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/822,032

(22) Filed: Aug. 10, 2015

Related U.S. Application Data

(60) Provisional application No. 62/142,210, filed on Apr. 2, 2015.

(51) Int. Cl.

| | |
|---|---|
| ***F42C 19/12*** | (2006.01) |
| ***F42B 3/12*** | (2006.01) |
| ***F42B 3/195*** | (2006.01) |
| ***F42C 19/08*** | (2006.01) |

(52) U.S. Cl.
CPC . *F42C 19/12* (2013.01); *F42B 3/12* (2013.01); *F42B 3/124* (2013.01); *F42B 3/195* (2013.01); *F42C 19/0811* (2013.01); *F42C 19/0838* (2013.01)

(58) Field of Classification Search
CPC .. F42C 19/08; F42C 19/0811; F42C 19/0815; F42C 19/0807; F42C 19/0838; F42C 19/12; F42B 3/10; F42B 3/103; F42B 3/12; F42B 3/13; F42B 3/124; F42B 3/128; F42B 3/195; F42B 3/198
USPC ..... 102/200, 202, 202.1, 202.5, 202.7, 102/202.8, 202.12, 202.14
See application file for complete search history.

(56) References Cited

U.S. PATENT DOCUMENTS

| | | | | |
|---|---|---|---|---|
| 3,978,791 | A * | 9/1976 | Lemley | F42D 1/04 102/202.14 |
| 5,291,828 | A * | 3/1994 | Nerheim | F42C 19/08 102/202 |
| 7,055,437 | B1 * | 6/2006 | Robinson | F42C 15/184 102/222 |
| 7,069,861 | B1 * | 7/2006 | Robinson | F41A 17/56 102/222 |
| 7,895,947 | B1 * | 3/2011 | Sutherland | F42C 15/188 102/254 |
| 8,276,516 | B1 * | 10/2012 | Nance | F42B 3/124 102/202.5 |

* cited by examiner

*Primary Examiner* — James S Bergin
(74) *Attorney, Agent, or Firm* — Christopher A. Monsey

(57) ABSTRACT

Apparatuses and methods are provided including electrically fired detonator are provided using, e.g., secondary explosives (SE), that have increased safety and reliability relative to primary explosives (PE). PEs require a lower amount of energy or shock to detonate than SEs thus are more difficult to initiate than PEs; SEs are less sensitive to shock or energy than PEs. SEs increase safety but suffer design difficulties in using such SEs in place of PEs that are more susceptible to undesired detonation. Various embodiments are provided including a metalized barrel with a specific thickness that is filled with a SE having a required diameter that has structures that provide efficient transfer/conversion of electrical energy into a detonation of the SE by, among other things, reducing electrical and mechanical/chemical losses. Embodiments of the invention also include various methods of design, use, and manufacturing.

12 Claims, 6 Drawing Sheets

IMPLODING BARREL INITIATOR AND RELATED METHODS

CROSS-REFERENCE TO RELATED APPLICATIONS

The present application claims priority to U.S. Provisional Patent Application Ser. No. 62/142,210, filed Apr. 2, 2015, entitled "IMPLODING BARREL INITIATOR AND RELATED METHODS," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,221) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to an explosive initiation device. In particular, embodiments of the invention include an imploding barrel initiator, other alternative apparatus embodiments, and related methods of making, use, etc.

Sensitivity of explosives can be referred to as a degree to which an explosive can be initiated by impact (or shock), heat, or friction. Sensitivity, stability and brisance are three significant properties of explosives that affect subsequent use and application. All explosive compounds have a certain level of of energy and power required to initiate. If an explosive is too sensitive, it may go off accidentally. A safer explosive is less sensitive and will not explode if exposed to certain inadvertent conditions, e.g. certain levels of energy in the form of heat, or shock. However, such explosives are more difficult to initiate intentionally—such a difficulty in initiation or detonation can increase as the size of an application gets smaller. High explosives can be conventionally subdivided into two explosives classes, differentiated by sensitivity: Primary explosives are extremely sensitive to mechanical shock, friction, and heat, to which they will respond by burning rapidly or detonating. Secondary explosives are relatively insensitive to shock, friction, and heat and are much less likely to be inadvertently initiated.

Some existing initiation systems can include hot wire (HW) detonators, Exploding Bridgewire (EBW) detonators, Exploding Foil Initiators (EFI), Low Energy Exploding Foil Initiators (LEEFI), and Ultra Low Energy Exploding Foil Initiators (ULEEFI). HW detonators can be manufactured using extremely sensitive primary explosive. EBWs often employ explosives e.g., Pentaerythritol, Tetranitrate (PETN), which are less sensitive than the explosives employed in the HW detonators. The EFI category (including EFI, LEEFI, and ULEEFI) use other explosives that are even less sensitive and more difficult to initiate. Examples of these explosives such as Hexanitro stilbene (e.g., HNS-IV) and RSI-007 explosives are so safe that they are approved for use in-line with the energetic firing train.

HW initiators employ very sensitive pyrotechnics or primary explosives, and require only a few amps of current to heat a resistive bridge of ~1-10 Ohms. Such systems can have a very low input energy requirement (5-50 mJ), and can have a very low current rate of rise (Amps/millisecond) requirements. As a result, HW initiators can have unintentional firing sensitivities often due to factors such as electromagnetic radiation and electrostatic discharge; these can be initiated by many common intentional and unintentional sources such as common flashlight batteries. These sensitivities restrict HW initiators use to systems that keep the detonator out of line or separated until activation.

EBW detonators can be comprised of a thin gold wire that bridges the two input legwires. The bridge can burn out at several amps, but will not detonate the explosive that is packed next to it, unless hundreds of amps are sent to the bridge in a few microseconds. These types of detonators can be significantly safer than HW detonators, from both an electrostatic discharge (ESD) as well as hazard of electromagnetic radiation to ordnance (HERO) perspective, due to their significantly higher threshold current (hundreds of amps vs a few amps), and required current ramp rate (hundreds of amps per microsecond). For short distances between the firing circuit and the detonator, standard firing wire is used; for longer firing distances, a coaxial cable is employed. Such design approaches can make the EBW detonator cable assemblies easy to build and employ. One initial explosive that can be pressed against the bridgewire can be PETN. Experts disagree on whether PETN is a primary or secondary explosive. For this reason, PETN based detonators are frequently not approved for use in an explosive train unless there is an out of line safe and arming device included in the firing train.

EFI detonators are one class of existing explosive initiators (including LEEFI and ULEEFI), being both safer than some types of initiators and having similar energy requirements as EBW detonators. EFI detonators can include an insensitive explosive that is approved for in-line use, such as HNS-IV or RSI-007. EFI detonators can be resistant to HERO and ESD factors and can be designed to be safer than older options. Primary drawbacks of EFI detonators, relative to EBWs, include cost and a requirement of a current ramp rate that is approximately 10-100 times faster, thus requiring modifications such as, e.g., use of controlled impedance cables and significant restriction on component placement and supporting electronic hardware to reliably fire a EFI.

Some initiator designs use sensitive (e.g., primary) explosive within metallization structures. However, simply using a same or similar metallization of a barrel with respect to a detonator in a substrate holding a pyrotechnic mix and/or sensitive/primary explosives will not generate a sufficient shock effect to detonate a secondary explosive material. Any explosive column diameter smaller than a critical diameter will not sustain a detonation. A certain amount of explosive is needed in order for an explosive mass to create a self-sustaining explosive detonation (e.g., a detonation can be defined as a process where the explosive will react at a rate where the explosive is consuming itself faster than a speed of sound in the explosive material). A design for detonating secondary, as well as sensitive, explosives must have a barrel which is large enough in view of the secondary explosive's critical diameter (for detonation) but not too large that results in unnecessary energy requirements needed to achieve secondary explosive detonation pressure from vaporization of barrel metallization. In other words, significant effort and analysis has been necessary to determine, among other things, a barrel metallization thickness, along with other elements, required to generate a sufficient level of shock to detonate the secondary explosive but not be too thick so as to expend unnecessary energy (e.g., spending energy to vaporizing metal that was not necessary for detonation of the secondary explosives). Additional factors also impacting a design include a diameter of a barrel/hole and ensuring a means of conveying electricity to the barrel without losing a significant amount of energy that then results in a misfire, dud, or failure to detonate.

For example, a secondary explosive (e.g., Cyclotrimethylenetrinitramine (RDX)) might be used with a metallization barrel although its critical diameter of an explosive for RDX is ~5.2 millimeters. If a design had a barrel diameter of 20 microns, that diameter would be on the order of two hundred and fifty times too small to detonate the RDX—certainly not reliably.

A variety of factors can render a design incapable of providing required conditions for detonating of a primary or insensitive explosive. For example, a detonator might use a semiconductor material to convey electrical energy into a metalized barrel containing an explosive such as, e.g. a secondary explosive. However, if the semiconductor's substrate is a doped silicon substrate, it may not conduct electricity as efficiently as metal and the overall device efficiency will be lower.

Other designs might try to use silicon to distribute current to a detonator barrel. In this scenario it is difficult to ensure uniform current density in the barrel. In that case, a primary consideration is delivery of uniform current density in the barrel structure, which can be difficult to achieve especially when the bottom of the barrel is also plated. Moreover, systems that merely rely on heating versus generating a shock from turning the metal into high speed plasma will not detonate secondary or insensitive explosives.

Yet other designs might try to use semiconductors in relation to detonation barrel design with respect to sensitive explosives using firing voltages of, e.g., 6-10 volts or, resistance of, e.g., 1-10 Ohms. As is such, these designs will not practically detonate a secondary explosive. Their predicted resistance is higher than an exemplary embodiment of the invention, which is capable of less than 1 Ohm resistance. Said embodiment offers additional resistance to inadvertent input stimulus such as radio frequency or electrostatic energy, as well as ensure that other inadvertent sources cannot provide the critical current ramp rate required to initiate insensitive or secondary explosives. Such a semiconductor design also does not address key mechanics of how to construct a detonator so that it will initiate insensitive or secondary explosives.

Thus, various improvements to existing designs are needed to produce desired results such as safety and reliability along with ease of use and cost all at an electrical input energy that is lower along with other needed utility and advantages provided by various embodiments of the invention. Exemplary apparatuses and methods are provided including electrically fired detonators employing secondary explosives, which increase safety and reliability relative to primary explosives. Primary explosives require a lower amount of energy or shock to detonate than secondary explosives and are thus easier to detonate; secondary explosives are less sensitive to shock or energy than primary explosives, increasing safety but still suffering from some design difficulties. Various embodiments are provided, one of which being a metalized barrel with a specific thickness; the barrel is filled with a secondary explosive, having a required diameter with structures that provide efficient transfer/conversion of electrical energy into detonation of the secondary explosive by, among other things, reducing electrical and mechanical/chemical losses. Embodiments of the invention also include various methods of design, use, and manufacturing.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1A:
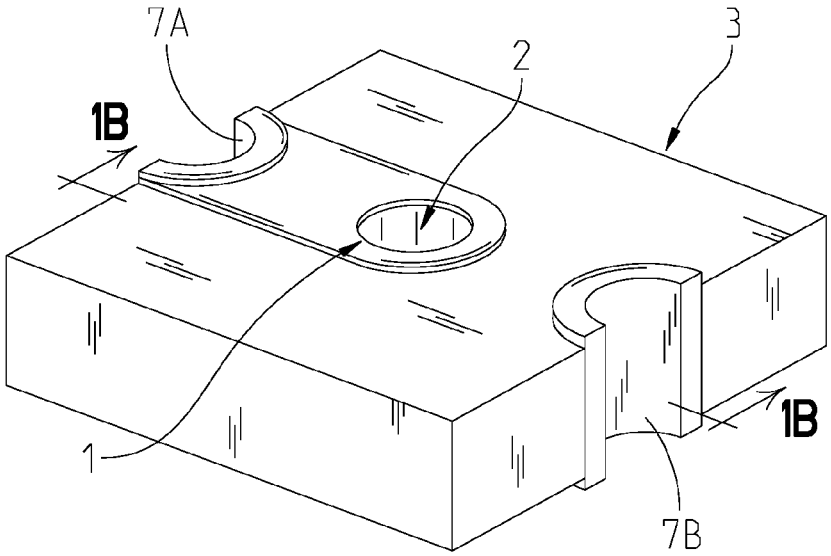
FIGS. 1A and 1B show an isometric and cross section view of an imploding barrel substrate and structures elements in accordance with one embodiment of the invention.
Figure 1B:
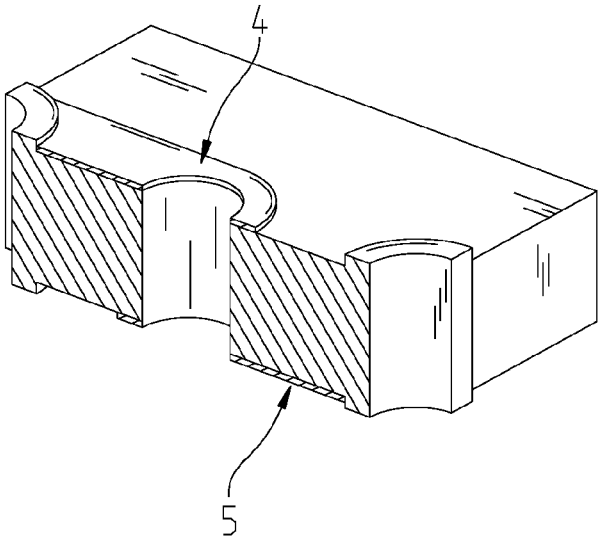

Referring initially FIGS. 1A and 1B, a view of an imploding barrel substrate and structures elements in accordance with one embodiment of the invention is provided. A non-conductive substrate 3 can be formed with an imploding barrel structure 1, e.g., a hole or via, disposed therein from one side of the substrate to another where the hole is coated with a thin metallization requiring particular metal and dimensioning according to various embodiments of the invention. The imploding barrel structure 1 (hole, barrel, and via can be used herein interchangeably and are referring to the same structure—barrel structure 1) can have a coating, e.g., 0.05 to 0.4 micrometer (hereinafter microns) metallization coating, that can be formed with gold and an underlying conductive seed layer (e.g., titanium tungsten alloy (TiW)) that should be minimized in thickness, e.g., less than one percent of the metallization coating. An exemplary substrate 3 can be made from Pyrex, quartz, or alumina ceramic with, e.g., substrates with a target porosity of less 0.01 microns in the hole. An exemplary imploding barrel 1 embodiment has via holes, e.g., imploding barrel 1, which are tapered to facilitate sputtering prior to imploding barrel or hole 1 plating. An initial or first explosive fill 2 can be placed in the imploding barrel or hole 1, e.g., filling the imploding barrel or hole 1, in contact with walls of the barrel or hole 1 and its metallization layer. A top metallization 4 and bottom metallization 5 are provided on opposing sides of the substrate 3 that are formed to receive electrical energy from a source or bus (not shown) so as to electrically couple respectively to opposing ends or sections of the barrel or hole 1 metallization so as efficiently transfer electrical energy into and through the imploding barrel structure or hole 1. Input conductors 7A and 7B can be formed into and through the substrate 3 as, e.g., a hole with conductive material that provides an electrical connection point between the electrical source or bus (not shown) which are connected to top metallization 4 and bottom metallization 5 as well as a mechanical connecting point to mount the substrate to another structure (e.g., header assembly 8, such as shown, e.g., in FIG. 2).

Figure 2:
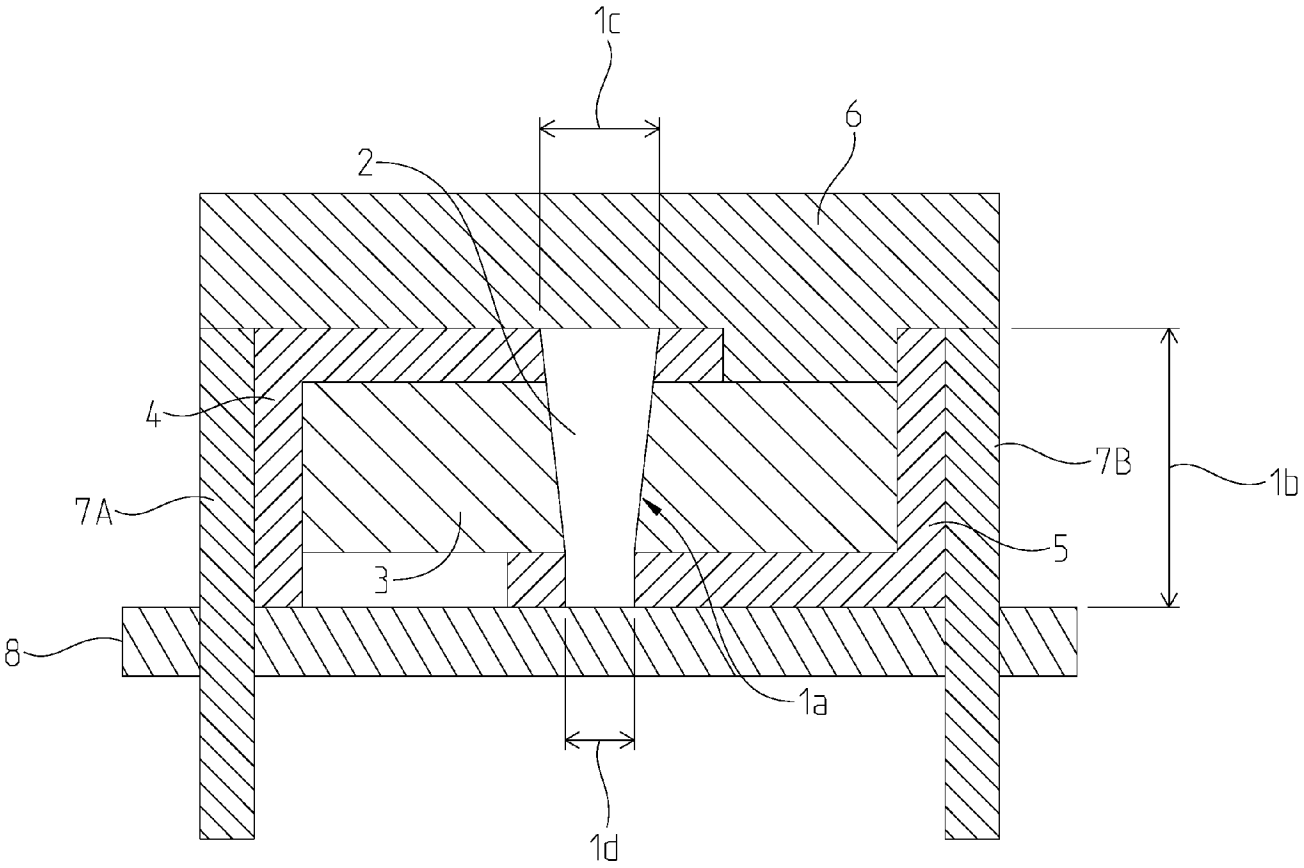
FIG. 2 shows a simplified cross section of one assembly in accordance with an embodiment of the invention that includes aspects of FIGS. 1A and 1B substrate and elements.

Referring to FIG. 2, the FIGS. 1A and 1B structures are shown with additional details such as, e.g., imploding barrel metallization 1*a* and thickness 1*a* which can be chemically inert to the initial explosive 2 and explosive output pellet 6 fill during normal storage and transport cycles; one embodiment uses gold for imploding barrel metallization 1*a*, but other metals may be used. Imploding barrel metallization 1*a* can also be thick enough to impart a required shock/pressure to initiate the initial explosive 2, yet thin enough so that electrical energy is not wasted in unnecessary vaporization during an initiation sequence. One embodiment can use gold as the imploding barrel metallization 1*a* of a thickness between 50 and 500 nanometers, but other materials and thicknesses will apply depending on an explosive, material, and barrel diameter. Given that a resistance of the imploding barrel metallization 1*a* will be very low and the imploding barrel metallization 1*a* can be distributed over a larger surface area, it will be able to tolerate higher input power without melting out/dudding. Thus, embodiments can yield a device with a higher resistance to unintentional electromagnetic energy without dudding or melting out.

With regard to barrel length 1*b*, a longer barrel length can provide a greater probability of a run up to detonation. However, a detonator that could undergo a deflagration to detonation (DDT) due to high temperature environmental exposure (burning) is not desirable. Therefore a barrel length needs to be long enough to support intended initiation, but short enough to prevent a DDT when exposed to a fire.

A top imploding barrel diameter 1*c* and bottom imploding barrel diameter 1*d* can be formed to create a tapering shape of the imploding barrel 1. This taper assists in manufacturing of both the metallized imploding barrel 1, allowing for a thin adhesion layer to be sputtered onto the substrate 3 to facilitate adhesion and plating of the metalized imploding barrel 1 using, e.g., gold.

Exemplary embodiments of the imploding barrel 1 can have an imploding barrel diameter and ratio of imploding barrel diameter to imploding barrel length (or substrate 3 thickness) design having several competing factors in this ratio. In one example, a minimum imploding barrel diameter can be several times (e.g., 2-10) a critical diameter of the initial explosive 2; particle size of the initial explosive 2 can also be important. Imploding barrel diameter cannot be too large, as it must be small enough to ensure the entire initial explosive 2 within the imploding barrel 1 receives a required level and duration of mechanical shock to sustain a detonation of the initial explosive 2. As a diameter of the exemplary imploding barrel 1 increases, one example of the imploding barrel 1 metallized wall 1*a* thickness must also increase to ensure adequate shock energy to the confined volume of the initial explosive 1. In this example, both factors seek to minimize a diameter and material thickness of an exemplary embodiment of the imploding barrel, yet exemplary initial explosive 2 must be large enough to cause high order detonation the output pellet 6.

In some embodiments, a vent mechanism (not shown) can be formed to vent gasses from unintentional burning or deflagration of the initial explosive. For example, a passage way or vent (not shown) between or opening into the initial explosive and header assembly 8 juncture. Depending on the barrel length, the vent mechanism should be sized such that violently deflagrating or exploding explosive will run pressure up to a detonation event even with the vent. The vent will allow more slowly burning explosive a mechanism to vent gas to prevent a pressure run up to detonation pressure.

In one embodiment, initial explosive 3 material can be selected to be a combination of a small critical diameter which is also relatively insensitive enough to be approved for in-line use and ease of manufacturing. In one embodiment, RSI-007 or EDF-11 has been selected, but other insensitive or secondary explosives could be used with various tradeoffs in input energy, size, and sensitivity.

One embodiment can include a nonconductive substrate 3 can be comprised of a variety of substrates that are compatible with manufacturing processes such as Alumina Ceramic, Aluminum Nitride, Glass, Sapphire. Any of these substrates can be laser machined, and plated to a needed thickness. Substrate 3 material can also be used as the part of the header assembly 8 if required. In one embodiment, a purpose of the non-conductive substrate 3 includes minimizing losses in transferring electrical energy to the imploding barrel 1, and must be strong and dense enough to provide adequate inertial confinement on a detonation reaction.

Embodiments can include a top metallization 4 that can be significantly thicker (e.g., 100-1000 times) than the imploding barrel metallization 1*a*. Top metallization 4 can connect to the header input conductor(s) 7A, 7B through soldering or welding processes. Bottom metallization 5 can be of a same or similar thickness to top metallization 5 and can also connect to the header input conductor(s) 7A, 7B through soldering or welding processes.

An embodiment can include an explosive output pellet 6 that can be formed of an explosive that is reasonably sensitive, yet still approved for in-line use, such as HNS IV, RSI-007, or EDF-11. Header input conductors 7A, 7B can be conductors formed with or as a hole that can connect or be aligned with a hole through the header assembly 8 where different input conductors 7A, 7B are electrically isolated from one another to allow current to pass into and out of the imploding barrel 1.

Exemplary header assembly 8 serves several purposes such as, for example, providing inertial backing (tamping) of a closed end of an exemplary imploding barrel 1 to prevent explosively generated gas pressure losses away from the explosive output pellet 6. Another purpose can include providing a mechanical foundation that serves to give support to the input conductors 7A, 7B.

Figure 3:
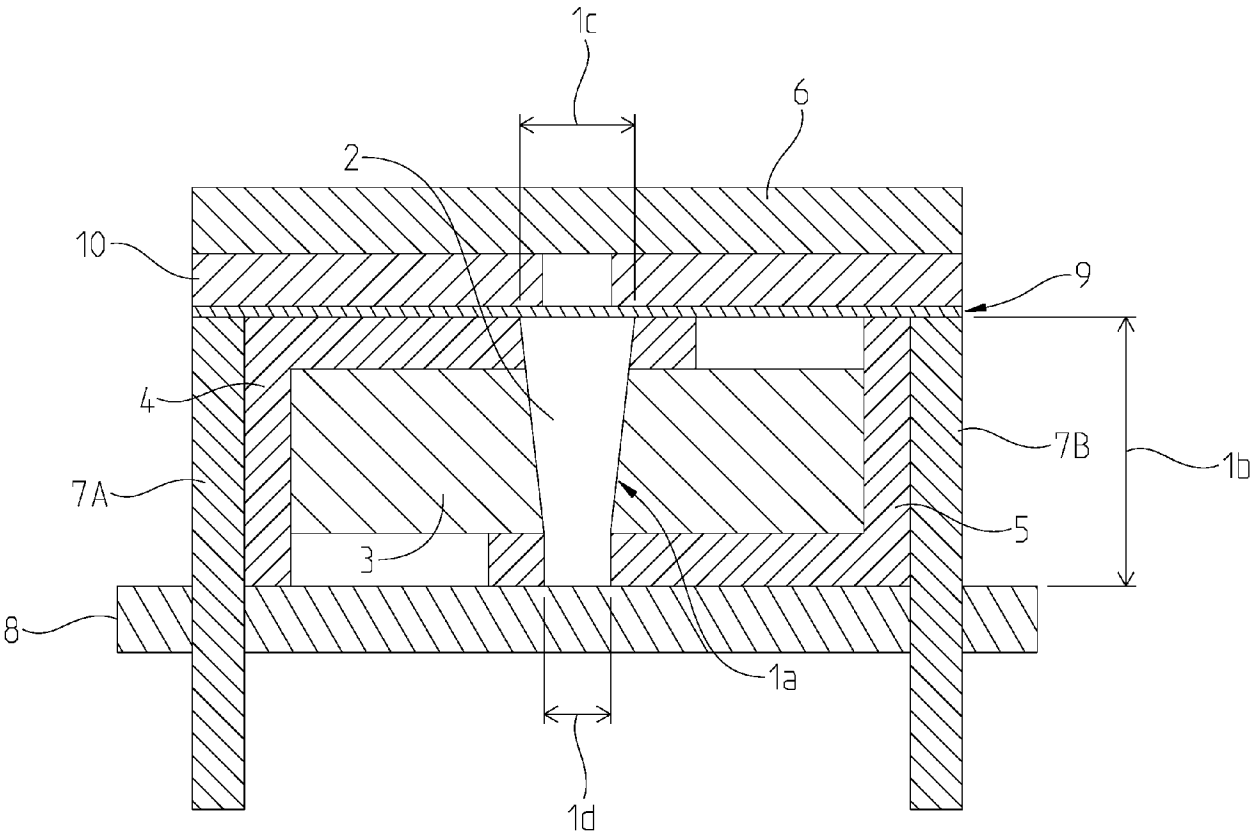
FIG. 3 shows another simplified cross section of another assembly in accordance with another embodiment of the invention.

Referring to FIG. 3, an alternate embodiment employs similar construction as the primary embodiment for FIGS. 1-2 elements 1-8 however one embodiment adds a flyer 9 and a flyer barrel 10. For example, flyer 9 and flyer barrel 10 can provide an alternate mechanism for accommodating a slower reaction rate of the initial explosive 2 in the imploding barrel 1. Explosive output pellet 6 can fail to detonate when a reaction within the imploding barrel 1 happens too slowly. If such a condition occurs, it still may be possible to use that slower energy reaction to accelerate the flyer 9 down the flyer barrel 10 to a speed that will detonate the explosive output pellet 6 when impacted by the flyer.

In some embodiments, the flyer 9 can serve to capture energy in a detonation that is slower than required to directly initiate the explosive output pellet 6. As the flyer 9 is accelerated down the flyer barrel 10, its velocity and kinetic energy increase. Once the flyer 9 impacts the explosive output pellet 6, if the flyer 9 has adequate velocity, the flyer 9 will impact initiate the explosive output pellet 6. An exemplary flyer barrel 10 can be formed as an inert spacer made of a variety of materials that serves to provide a volume of empty airspace for the flyer 9 to increase its velocity prior to impacting the explosive output pellet 6.

Figure 4A:
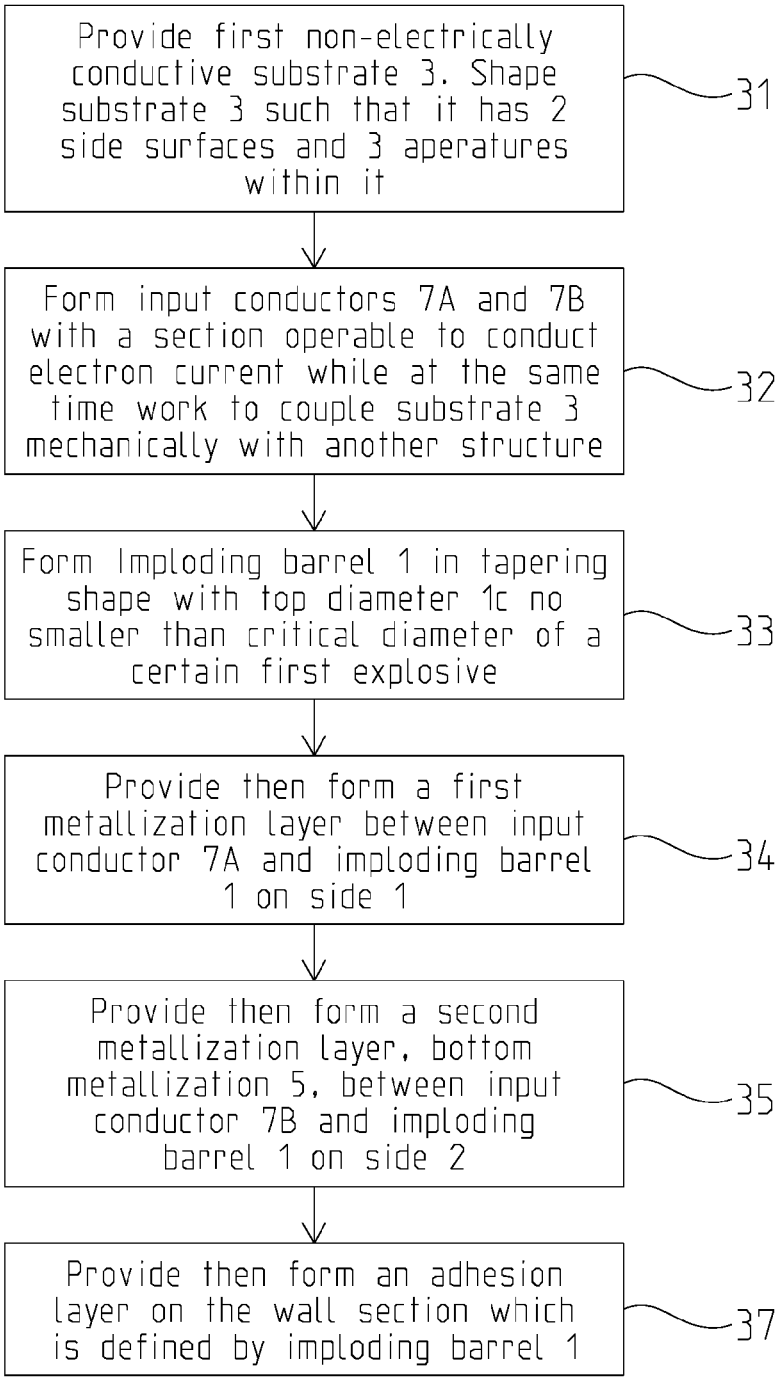
FIGS. 4*a* and 4*b* shows an exemplary simplified method of designing and manufacturing in accordance with one embodiment of the invention.

FIG. 4 shows an exemplary simplified method of designing and manufacturing in accordance with one possible embodiment of the invention. In FIG. 4*a*, Step 31: providing a first substrate 3 comprising a non-electrically conductive material. The first substrate 3 can be shaped such that there are two opposing sides (e.g., sides A and B) and three apertures within said first substrate through said two opposing sides. The first, second and third apertures, input conductor 7A, imploding barrel 1, and input conductor 7B, respectively, can all go through the first substrate 3 from side A to side B. The input conductors 7A and 7B can be formed with a conductive section operable to receive an electric current up to a first predetermined level; said input conductors 7A and 7B also can be formed to mechanically couple the first substrate 3 to another structure. At Step 33, the imploding barrel 1 can be formed in a tapering shape, e.g., one end is larger than another end, with a top diameter 1*c* greater than or equal to a critical diameter of explosive of a first explosive.

At Step 34: providing a first metallization layer formed between input conductor 7A and imploding barrel 1 on side A, e.g., top metallization 4. Step 35: providing a second metallization layer 5 formed to electrically couple the input conductor 7B on Side B of the first substrate 3 and a section or surface of the imploding barrel 1 in proximity to Side B. At Step 37: providing an adhesion layer formed on a wall section defined by said surface of imploding barrel 1 from side A to side B.

Figure 4B:
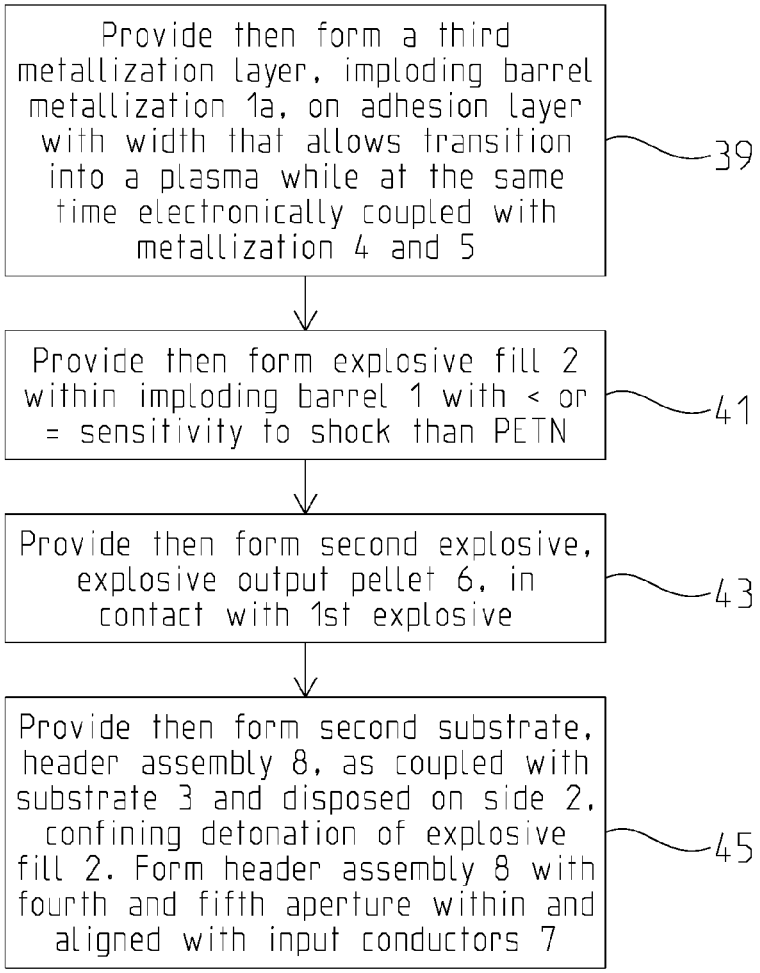

In FIG. 4*b*, at Step 39: providing and forming a third metallization layer comprising an imploding barrel metallization layer 1A formed on the adhesion layer, wherein the imploding barrel metallization layer 1A is formed to electrically couple with metallizations 4 and 5. Imploding barrel metallization layer 1A is formed with a thickness determined based on an energy required to convert the imploding barrel metallization layer 1A into a plasma sufficient for creating a first shock or energy level.

At Step 41, providing and forming a first explosive comprising said initial or first explosive fill 2, disposed within the imploding barrel 1 from side A to side B on said third metallization layer 1A, wherein the explosive fill 2 can be any explosive having an equal or lower sensitivity to shock than PETN. At Step 43, provide then forming a second explosive comprising an explosive pellet 6 and disposing or positioning said second explosive on the first substrate 3 Side A over said imploding barrel 1 in proximity to or contact with the first explosive fill 2.

At Step 45: provide a second substrate comprising header assembly 8, formed, coupled with, and disposed on side B of the first substrate 3. Header assembly 8 can be formed with a material and coupled with the first substrate 3 while at the same time can be configured to confine the detonation of the first explosive 2 within imploding barrel 1 no less than a first force (of the first explosive). Header assembly 8 can be further formed with a fourth and fifth aperture that align with input conductors 7A and 7B.

Figure 5:
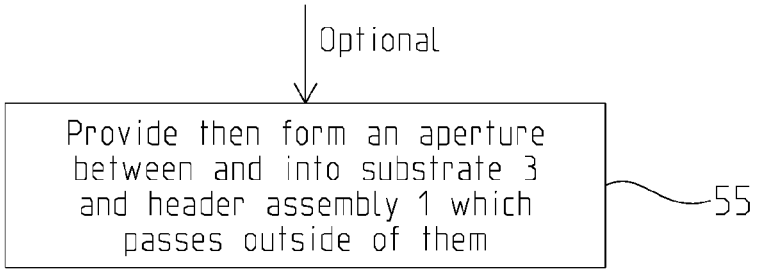
FIG. 5 shows an optional step for the continuance of method of manufacturing the embodiment of the invention from FIGS. 4*a* and 4*b;*

FIG. 5 shows an optional step for the continuance of the method of manufacturing the embodiment of the invention from FIGS. 4A and 4B. The device could be further comprised at Step 55 providing sixth apertures respectively formed between and into the first and second substrates passing outside of first substrate 3 and header assembly 8, operable to vent gasses from explosive output pellet 6 below the first force.

Figure 6:
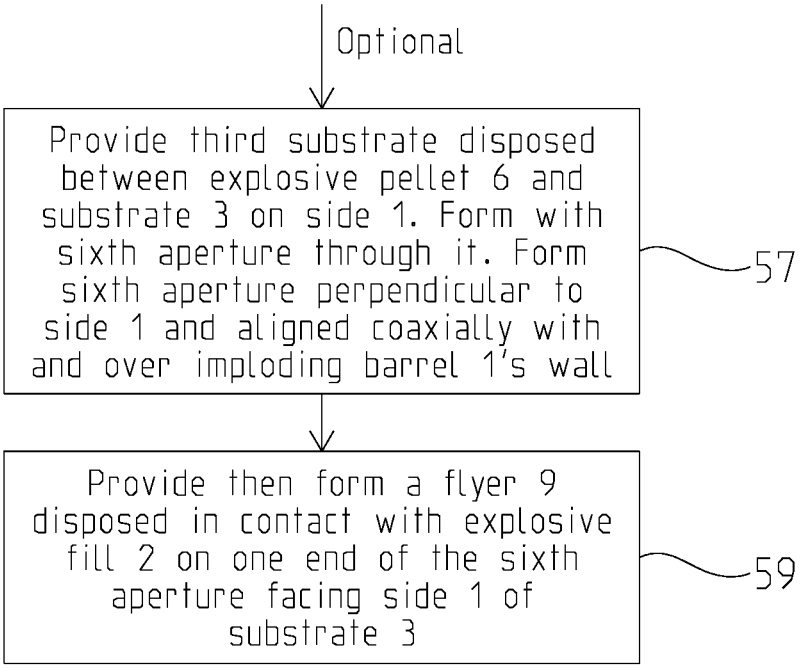
FIG. 6 shows two more consecutive optional steps for the method of manufacturing the embodiment of the invention from FIGS. 4*a* and 4*b.*

FIG. 6 shows two more consecutive optional steps for the method of manufacturing the embodiment of the invention from FIG. 4. Step 57: providing a third substrate disposed between the second explosive and the first substrate on the first side. The third substrate, flyer barrel 10, can be formed with a sixth aperture or sleeve through it. The sixth aperture or sleeve would be perpendicular to side 1 and can be formed to align its sides coaxially with and over imploding barrel 1's wall. Finally, Step 59 concludes with the device further comprising a flyer 9 disposed in releasable fixed contact with the explosive fill 2 on one end of the sixth aperture facing side 1 of substrate 3. The flyer can be configured to be driven through the inner channel by the first force or shock to impact and detonate explosive output pellet 6.

An exemplary embodiment can include selection of the secondary explosive comprising one of a group having said first force or shock of at least one of a group comprising RSI007, EDF11, CL-20, and HNSIV based explosives. Although this design is intended to initiate secondary insensitive explosives, an alternate embodiment can also include selection of the primary explosive from a group comprising a material having said second force or shock of at least one of a group comprising lead azide and lead styphnate.

An exemplary header assembly 8 is formed, coupled with, and disposed on the non-conductive substrate 3. Said header assembly can also be formed with a material and coupled with the nonconductive substrate 3 so as to be configured to confine a detonation of the secondary explosive within said imploding barrel, e.g., no less than said a detonation force for the secondary explosive.

Substrate 3 can be formed with material, dimensions, etc sufficient to have a necessary tensile strength and density to contain detonation reaction of the initial explosive (e.g., secondary or insensitive explosive).

Note, use of the term "secondary" 2 and "initial explosive" 2 can be used interchangeably herein. The explosive output pellet 6 can be made of a secondary explosive as well. The initial explosive 2 can also be an insensitive explosive. For purposes of convenience and providing a definite description that can be objectively determined, a secondary explosive can be defined as any explosive having an equal or lower sensitivity to shock than PETN. However, alternate approaches to defining sensitivity levels relative to what is or is not a secondary or primary explosive can be used.

Surface finish of the imploding barrel 1 in substrate 3 has been found to require a surface finish to allow for a thinnest possible metallization yet still have a uniform shape that is not distorted by underlying substrate 3 texture.

Thus, various improvements and innovations from different embodiments of the invention can provide desired results with use of insensitive or secondary explosives such as safety and reliability along with ease of use and cost all at an electrical input energy that is lower, at a smaller size or a size usable with a variety of desired applications, along with other needed utility and advantages provided by various embodiments of the invention. Although the invention has been described in detail with reference to certain preferred embodiments, variations and modifications exist within the spirit and scope of the invention as described and defined in the following claims.

The invention claimed is:

1. An explosive device comprising:

a first substrate formed with a non-electrically conductive material formed with a first and second side as well as a first, second, and third aperture through said substrate from said first to said second side, wherein said second aperture is formed in a tapering shape where one end is larger than another end;

a first metallization layer formed between said first and second apertures on said first side;

a second metallization layer formed between said second and third apertures on said second side;

an adhesion layer formed on a wall section defined by said second aperture from said first to said second side, a third metallization layer formed on said adhesion layer, wherein a portion of said third metallization layer is electrically coupled with said first and second metallization layers at, within and adjacent to said second aperture;

a first explosive disposed within said second aperture from said first side to said second side, wherein said first explosive is any explosive having an equal or lower sensitivity to shock than PETN;

a second explosive positioned on said first side and positioned over said second aperture;

wherein said second explosive positioned in proximity or contact with said first explosive;

a second substrate formed, coupled with, and disposed on said second side of said first substrate, said second substrate is formed with a material and coupled with said first substrate that is configured to confine a detonation of said first explosive within said second aperture no less than a first force produced from said first explosive, said second substrate is further formed with a fourth and fifth aperture that align with said first and third apertures;

wherein said first and second apertures are formed with a conductive section operable to receive an electric current up to a first predetermined level and also to mechanically couple said first substrate to another structure;

wherein said second aperture is formed with a diameter no smaller than a critical diameter of said first explosive required to sustain detonation of said first explosive;

wherein said third metallization layer is formed with a width determined based on energy required to turn said third metallization layer into a plasma sufficient to create said first shock or energy level;

wherein said first and second metallization layers are at least one hundred times thicker than said third metallization layer.

2. A device as in claim 1, wherein said second metallization layer comprises gold.

3. A device as in claim 1, wherein said first explosive comprises one of a group having said first force or shock of at least one of a group comprising RSI007, EDF11, CL-20, and HNSIV based explosives.

4. A device as in claim 1, further comprising an aperture formed between and into the first and second substrates passing outside of said first and second substrates operable to vent gasses from said first explosive below said first force.

5. A device as in claim 1, wherein said second explosive comprises a material having a second force or shock of at least one of a group comprising lead azide and lead styphnate.

6. A device as in claim 1, further comprising a third substrate disposed between said second explosive and said first substrate on said first side, said third substrate is formed with a sixth aperture or sleeve through said third substrate said sixth aperture or sleeve is perpendicular to said first side and is formed to align its sides coaxially with and over said second aperture's wall, said device further comprises a flyer disposed in releasable fixed contact with said first explosive on one end of said sixth aperture facing said first side of said first substrate, said flyer is configured to be driven through an inner channel by said first force or shock to impact and detonate said second explosive.

7. A method of designing and manufacturing an explosive device comprising:

providing a first substrate formed with a non-electrically conductive material formed with a first and second side as well as a first, second, and third aperture through said substrate from said first to said second side, wherein said second aperture is formed in a tapering shape where one end is larger than another end;

providing a first metallization layer formed between said first and second apertures on said first side;

providing a second metallization layer formed between said second and third apertures on said second side;

providing and forming an adhesion layer formed on a wall section defined by said second aperture from said first to said second side;

providing and forming a third metallization layer formed on said adhesion layer, wherein said third metallization is electrically coupled with said first and second metallization layers;

providing and forming a first explosive disposed within said second aperture from said first side to said second side, wherein said first explosive is any explosive having an equal or lower sensitivity to shock than PETN;

providing and forming a second explosive positioned on said first side and positioned over said second aperture, wherein said second explosive is formed with a position in proximity or contact with said first explosive; and providing a second substrate formed, coupled with, and disposed on said second side of said first substrate, said second substrate is formed with a material and coupled with said first substrate that is configured to confine a detonation of said first explosive within said second aperture no less than a first force produced by detonation of said first explosive, said second substrate is further formed with a fourth and fifth aperture that align with said first and third apertures;

wherein said first and second apertures are formed with a conductive section operable to receive an electric current up to a first predetermined level and also to mechanically coupled said first substrate to another structure;

wherein said second aperture is formed with a diameter no smaller than a critical diameter of said first explosive required to sustain detonation of said first explosive;

wherein said third metallization layer is formed with a width determined based on energy required to turn said third metallization layer into a plasma sufficient to create said first shock or energy level;

wherein said first and second metallization layers are at least one hundred times thicker than said third metallization layer.

8. A device as in claim 7, wherein said second metallization layer comprises gold.

9. A device as in claim 7, wherein said first explosive comprises one of a group having said first force or shock sensitivity of at least one of a group comprising RSI007, EDF11, CL-20, and HNSIV based explosives.

10. A device as in claim 7, wherein said second explosive comprises a material having a second force or shock of at least one of a group comprising lead azide and lead styphnate.

11. A device as in claim 7, further comprising providing an aperture formed between and into the first and second substrates passing outside of said first and second substrates operable to vent gasses from said first explosive below said first force.

12. A device as in claim 7, further comprising a third substrate disposed between said second explosive and said first substrate on said first side, said third substrate is formed with a sixth aperture or sleeve through said third substrate said sixth aperture or sleeve is perpendicular to said first side and is formed to align its sides coaxially with and over said second aperture's wall, said device further comprises a flyer disposed in releasable fixed contact with said first explosive on one end of said sixth aperture facing said first side of said first substrate, said flyer is configured to be driven through an inner channel by said first force or shock to impact and detonate said second explosive.

* * * * *